United States Patent [19]

Winn

[11] 4,177,902

[45] Dec. 11, 1979

[54] DISPLAY UNIT

[76] Inventor: Ronald R. Winn, 430 Ridge Ave., Galesville, Wis. 54630

[21] Appl. No.: 902,025

[22] Filed: May 2, 1978

[51] Int. Cl.[2] ..... A44F 5/10

[52] U.S. Cl. ..... 211/162; 40/491; 40/489

[58] Field of Search ..... 40/124, 486, 491; 211/162

[56] References Cited

U.S. PATENT DOCUMENTS

| | | | |
|---|---|---|---|
| 1,058,207 | 4/1913 | Van Allen | 40/491 |
| 2,779,107 | 1/1957 | Brace | 40/491 X |
| 3,883,004 | 5/1975 | Slaga | 211/162 |
| 3,945,510 | 3/1976 | Saul | 211/162 |
| 3,984,930 | 10/1976 | Booland | 40/491 |
| 4,132,020 | 1/1979 | Nidelkoff | 40/491 |

*Primary Examiner*—Louis G. Mancene
*Assistant Examiner*—Wenceslao J. Contreras
*Attorney, Agent, or Firm*—Wheeler, Morsell, House & Fuller

[57] ABSTRACT

A display unit has rolling panels entirely supported from the bottom and lacks a top frame. Each display panel is carried by wheels on a track which is adjustable to any front and back position with respect to the base of the stand. The top of each display panel carries a light-weight scissors whose sole function is to hold the panel vertical and which rolls in an upper track so that whatever position the bottom track is placed in, the upper scissors can accommodate to and hold the panel vertical.

4 Claims, 6 Drawing Figures

10
11
12
15
16
20
21
24
25
26
30
31
32
33

11
12
14
15
16
30
32
33
35
36

DISPLAY UNIT

BACKGROUND OF THE INVENTION

Probably the closest known prior art is applicant's own prior application Ser. No. 720,922. However, that had a much more complex upper and lower frame structure. The elimination of the upper frame both makes the panel more desirable visually, and makes it cheaper for the user. The adjustments of the panels fore and aft are extremely simple compared to the prior art, require few pieces, and can readily be adjusted to any required position by a complete novice. The rolling panels are locked into the frame for security against theft or accident.

SUMMARY OF THE INVENTION

The primary features that make my invention novel are securing the top end of each rolling panel to a back channel with an infinitely adjustable scissors linkage wheeled to roll in the channel, and a flanged channel to capture the wheels against accidental removal. These cooperate with a new and very simple bottom rolling track adjustment with no fixed required fore and aft panel positions to make an extremely flexible, handy, readily manufactured unit.

My display unit may be used as a display fixture in stores, or as a tool rack for mechanics, or as a storage facility for canned foods or supplies or the like.

DRAWINGS

DESCRIPTION OF THE INVENTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 6:
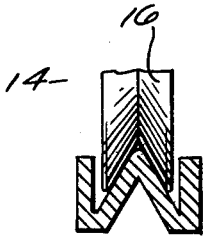
FIG. 6 is a fragmentary enlarged cross sectional view through the wheel and track on line 6—6 of FIG. 3.
Figure 5:
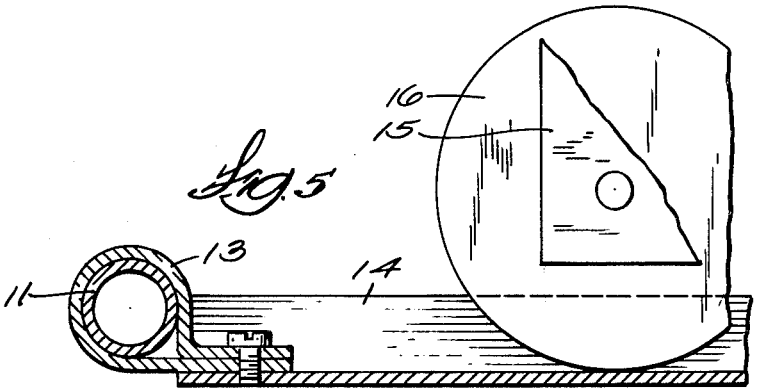
FIG. 5 is a cross sectional view on lines 5—5 of FIG. 3.

In its preferred from the frame consists simply of two L-shaped tubes 10 with the lowermost arm 11 of each L extending along the bottom of the rack, preferably but not necessarily at floor level and with the other arm 12 of the L extending vertically. Attached to the arms 11 of the L-shaped tubes by means of simple clamps 13, here shown as loops screwed to the channel bottoms, are simple upwardly opening channels 14 which serve as tracks for display panels movable from side to side. Because they are secured by simple clamps 13 to the tubes 10 forming the side frames, channels 14 may be placed anywhere with respect to the fore and aft dimension of the unit. Each channel 14 has a display panel 15 preferably of perforated board above it. Each display panel 15 has at least two wheels 16 rotatably mounted at its bottom of a width which fit into the channel 14 to provide the entire vertical support for the panel. If desired the channel 14 may have a W-shaped cross section and the wheel 16 may be V-shaped at its periphery for stability. See FIG. 6.

Figure 2:
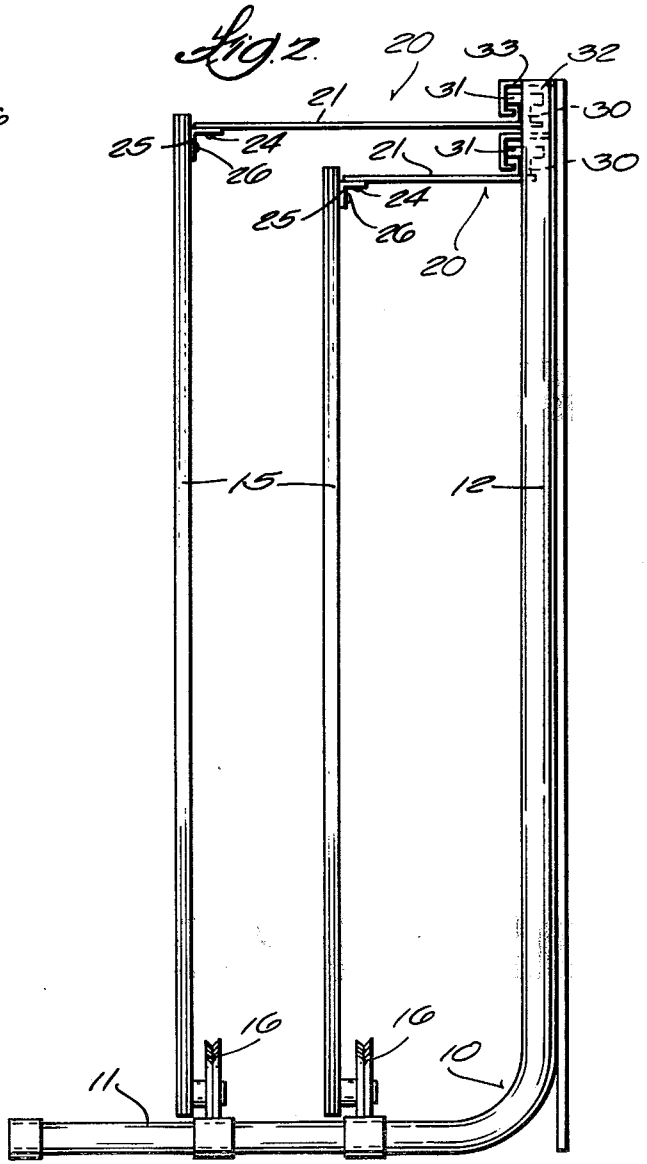
FIG. 2 is a side view of the device of my invention.
Figure 1:
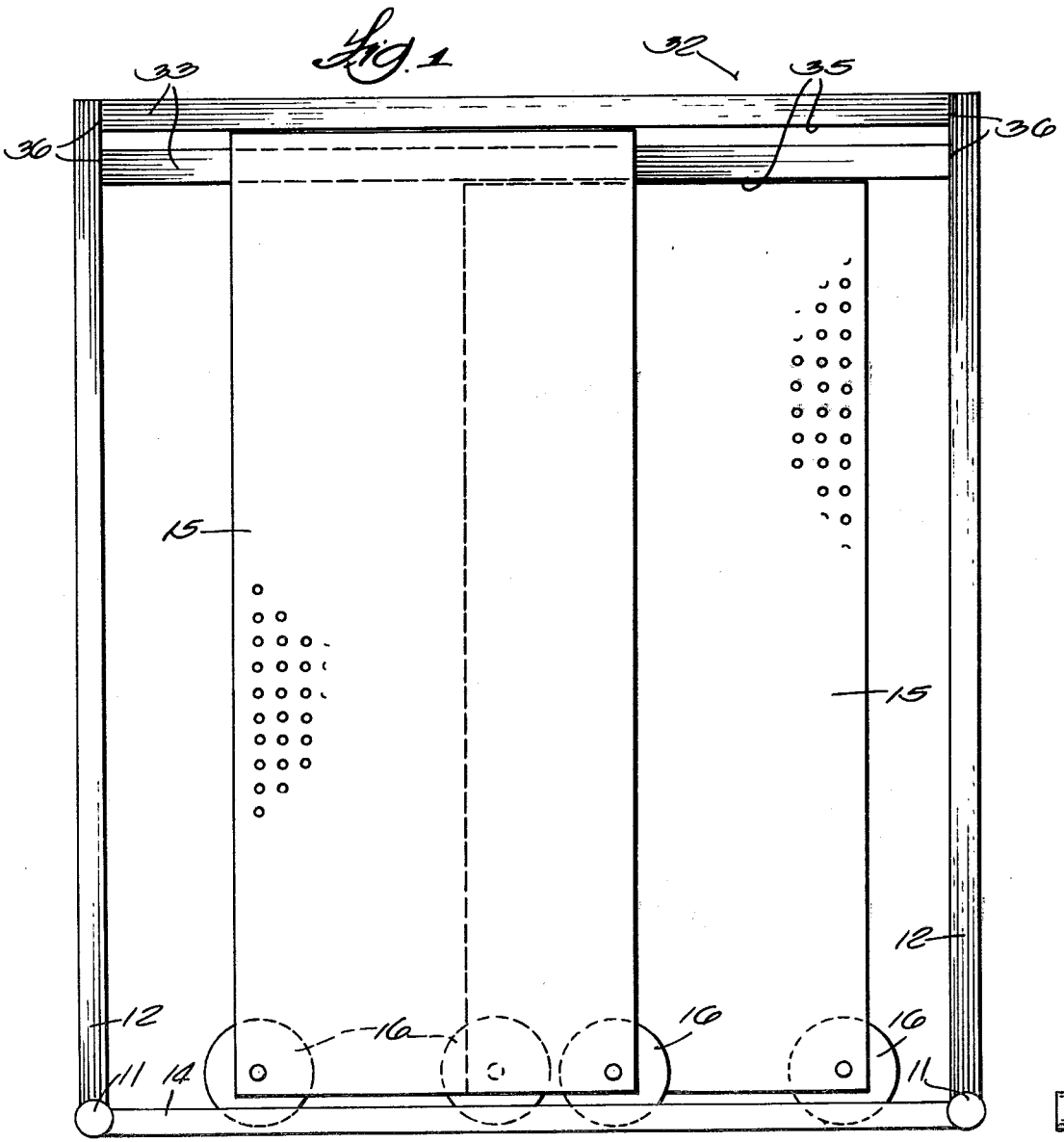
FIG. 1 is a front view of the device of my invention.
Figure 3:
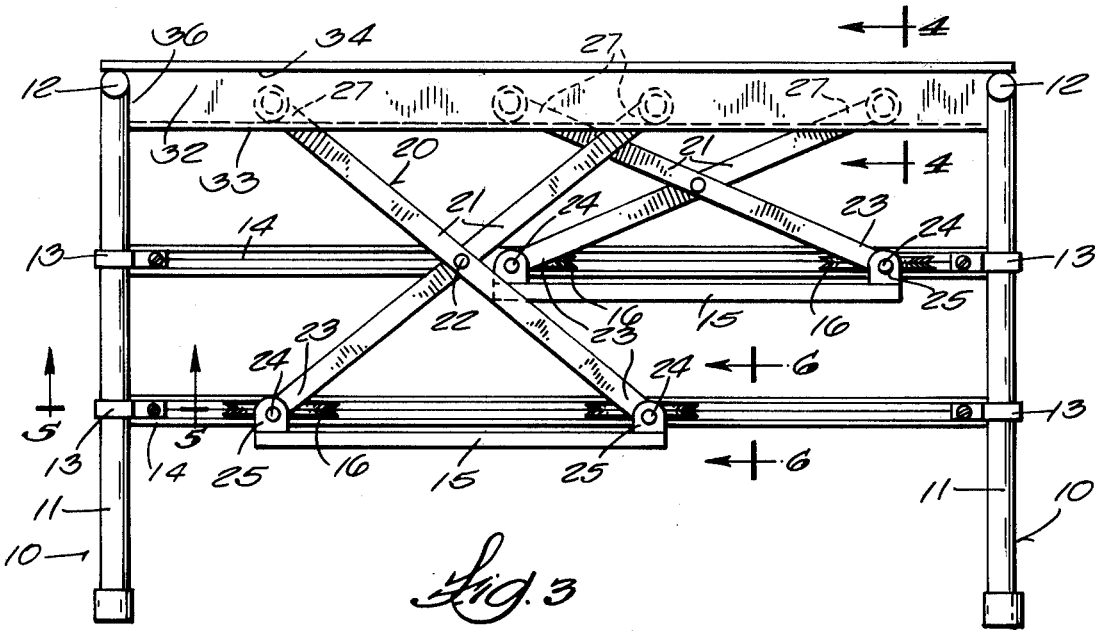
FIG. 3 is a top view of the device of my invention.
Figure 4:
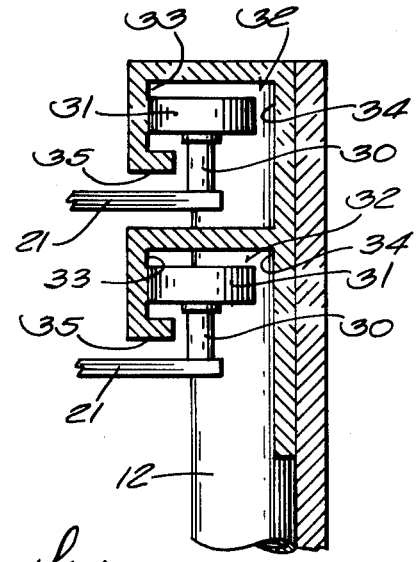
FIG. 4 is a cross sectional view on line 4—4 of FIG. 3.

There is no upper frame for my device. At the top of each display panel 15 is a scissor linkage 20. Each linkage 20 consists of at least a pair of light scissors link arms 21 pivoted to each other at the center 22. One end 23 of each scissors link 21 is pivoted at 24 to a mounting bracket 25 pivoted to link 21 and removably secured to one of the panels 15 by a fastener 26 which may extend through the panel, or by a clamp, or the like. In the case of pegboard panels 15 which are particularly suitable for such applications the fastener 26 may extend through an opening in the pegboard in a known manner. (FIG. 2) However, it is essential for the objectives of this invention that the connection between the scissors link 21 and the panel 15 be substantially infinitely adjustable. For that purpose, if the bracket 25 is primarily mountable only at a fixed series of points on the panel, the position of the end of the link may be adjustable in a known manner with regard to the fixed anchorage, for instance by a slotted opening in pivoted bracket or by drilling a special hole, unless the holes in the pegboard and sufficiently close together so that the anchor points available do not result in any substantial deviation of the panel 15 from vertical orientation, that being the purpose of the scissors linkage 20. In most cases the scissors linkage 20 for each panel will consist of a single pair of arms or links 21 but it is possible to utilize a multiple folding gate type arrangement with added pivoted links 21 if necessary.

The outer or back end of each link 21 is provided with a vertically extending stem 30 and with a larger roller or wheel 31 mounted on the stem as an axle, the roller 31 having a substantially larger diameter than the stem 30.

Extending between the sides 12 of the frame at the top are as many roller channels 32 as there are movable panels 15. Each such channel 32 is formed with parallel front and back surfaces 33, 34 which are contacted by the rollers 31 at the ends of the scissors links 21. Channels 32 open either upwardly or downwardly so that the axles or pins 30 on which the rollers 31 are mounted extend vertically into channels 32 may pass from side to side along the channels. Preferably at the free edge of the front surface 33 of the channel 32 there is an inturned flange 35 extending toward the parallel backwall 34 of the channel a sufficient distance so that the slot left for the roller axles 30 is not as wide as the diameter of the rollers 31. In this manner the rollers 31 may be inserted in the channels 32 only at the ends 36. Once the channel 32 is mounted between the sides 12 of the L-shaped frames 10 it is no longer possible for the roller 31 to leave the channel 32. The sole purpose of the scissors 20 at the top is to provide vertical stability to the panel while permitting infinite fore and aft adjustment and side to side movement of the panel without a top frame. The scissors does not support any weight and consequently can be of light construction. Panels 15 are of slightly different heights, or bracket 25 may be mountable at different heights so respective scissors 20 clear each other.

If desired, the back of the frame 10 may be filled in with a stationary panel such as pegboard also, to serve as a further storage or display surface.

It will be seen that the rack of my invention is extremely simple and that it is in addition easily adjustable by the user to place the sliding panels in any desired distance from each other for the storage or display of items of any size without any particular skill in using tools nor any complex instructions. Nevertheless the unit is exceedingly sturdy as well. Because all of the weight is supported at the bottom, which usually will rest upon a floor, no elaborate support arrangements are necessary.

I claim:

1. In an article display rack having a top, bottom, front, back, and left and right sides, a plurality of vertical bottom channels extending from left to right and slidable from front to back, a plurality of panels one above each channel slidable from left to right, a pair of front to back arms spaced or placed at the left side and the right side respectively of said channels, each said track being provided at each end with a clamping member to secure it to said fore and aft rod in any fore and aft adjusted position, an upper track comprising a vertically opening channel for each said panel, each panel being provided at its bottom with a plurality of wheels immediately adjacent the plane of the panel at the bottom only, and each said panel being provided with a scissors linkage at the top, each arm of the scissors linkage having a pivotal attachment to the panel at one end, a pivotal attachment to the other arm of the scissors at its center, and a panel aligning roller at its rearmost end, and the channel for each said roller having a depending flange to trap the roller in the track.

2. The device of claim 1 in which one scissors link is attached to the panel by clamping in infinitely adjustable positions whereby the front and rear extension of the scissors link is adjustable.

3. The device of claim 1 in which the channel is so formed that the roller at the end of each scissors link is insertable in the roller channel only from the end, after which the roller channel is mounted between the side tubes of the frame of the unit to capture the rollers within the channel.

4. The device of claim 3 wherein the depending flange of the roller channel has an inwardly extending flange at the bottom of the depending flange to trap the roller in the track, the lower capturing flange leaving a bottom opening to the channel which is less wide than the diameter of the roller.

* * * * *